US005388652A

United States Patent [19]

Smith

[11] Patent Number: 5,388,652

[45] Date of Patent: Feb. 14, 1995

[54] APPARATUS ON A DRILLING TOWER FOR GRIPPING A DRILL CASING

[75] Inventor: Donald W. Smith, Garland, Tex.

[73] Assignee: Ingersoll-Rand Company, Woodcliff Lake, N.J.

[21] Appl. No.: 204,578

[22] Filed: Mar. 2, 1994

[51] Int. Cl.[6] ..... E21B 19/14

[52] U.S. Cl. ..... 175/85; 166/77.5

[58] Field of Search ..... 166/77.5, 85; 175/85, 175/52, 171

[56] References Cited

U.S. PATENT DOCUMENTS

| | | | |
|---|---|---|---|
| 4,030,542 | 6/1977 | Poe et al. . | |
| 4,295,527 | 10/1981 | Russe . | |
| 4,595,066 | 6/1986 | Nelmark et al. | 175/85 |
| 4,686,873 | 8/1987 | Lang et al. | 166/77.5 X |
| 4,719,978 | 1/1988 | Klemm | 175/171 X |
| 4,813,493 | 3/1989 | Shaw et al. | 166/77.5 X |
| 4,843,945 | 7/1989 | Dinsdale . | |
| 4,854,400 | 8/1989 | Simpson | 175/85 |
| 5,042,601 | 8/1991 | Penisson | 166/85 X |
| 5,123,484 | 6/1992 | Bode . | |

*Primary Examiner*—Ramon S. Britts
*Assistant Examiner*—Frank S. Tsay
*Attorney, Agent, or Firm*—John J. Selko

[57] ABSTRACT

An apparatus on a drilling tower platform for gripping a vertically extending drill casing includes a drill bushing having a pair of casing gripping assemblies mounted thereon, one assembly of the pair including a first and second gripping jaw, with a common actuator therebetween, and the other assembly of the pair including a third and fourth gripping jaw, with a common actuator therebetween, the pair of gripping assemblies being positioned around the bushing so that the first and fourth gripping jaws grip the casing at approximately diametrically opposed locations and so that the second and third gripping jaws grip the casing at approximately diametrically opposed locations approximately 90 degrees from the first and fourth gripping jaws, as measured around the bushing.

6 Claims, 3 Drawing Sheets

APPARATUS ON A DRILLING TOWER FOR GRIPPING A DRILL CASING

BACKGROUND OF THE INVENTION

This invention relates generally to devices used in rotary drilling operations, and more particularly to devices used to clamp drill casing during coupling and uncoupling of sections of drill casing.

During drilling for wells or holes for foundation pilings, the ground formation sometimes will collapse inwardly causing the drill string to become stuck, or the hole to close after the drill sting is removed. When these conditions occur a pipe, referred to as casing, is used to shore-up the bore hole during and after drilling to keep the hole open. A common type of casing uses threaded ends and large pipe couplings to join sections together. When making (coupling together) these joints, if the ground has not collapsed sufficiently around the lower section, the casing will remain free to rotate, not allowing the upper casing portion of the joint to become tightened by rotation into the coupling. The reverse is also true when attempting to break joints (uncouple), the ground will not hold the casing from turning, and allow the joint to be unscrewed, which is required to remove casing sections.

A current solution to this problem is to use a device call slips. This consist of wedges that fit into tapered ways in the drill bushing. Although slips can work well, they can be cumbersome and time consuming to use. They must be driven into place in the tapered ways until they can grip the casing. This system is dependent on a down pressure supplied by the casing weight to develop its grip of the casing. For removal of the slips it is necessary to lift the casing. Slips commonly become stuck and not easily removed.

The foregoing illustrates limitations known to exist in present drill casing grippers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus having a hollow, tubular bushing mounted on said tower in a vertically extending position, said busing having a sidewall forming a passageway for a drill casing to pass vertically therethrough; a pair of casing gripping assemblies mounted on said tower, adjacent an outer surface of said sidewall, said gripping assemblies co-acting in a gripping stroke and in a release stroke; said pair of gripping assemblies spaced from each other adjacent approximately opposite portions of said sidewall; a first gripping assembly of said pair comprising: a first gripping jaw means for extending into said passageway through an aperture in said sidewall, for contacting a casing therein; a second gripping jaw means for extending into said passageway through an aperture in said sidewall, for contacting a casing therein; and a first actuator means for moving said first and second gripping jaw means into and out of said passageway; a second gripping assembly of said pair comprising: a third gripping jaw means for extending into said passageway through an aperture in said sidewall, for contacting a casing therein; a fourth gripping jaw means for extending into said passageway through an aperture in said sidewall, for contacting a casing therein; and a second actuator means for moving said third and fourth gripping jaw means into and out of said passageway; said first and second gripping assemblies being positioned around said sidewall so that said first and fourth gripping jaw means contact said casing at approximately diametrically opposite locations, and so that said second and third gripping jaw means contact said casing at approximately diametrically opposite locations approximately 90 degrees from said first and fourth gripping jaw means; and means for actuating said first and second actuator means to cause said first, second, third and fourth gripping jaw means to contact said casing at about the same time thereby securely gripping said casing.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
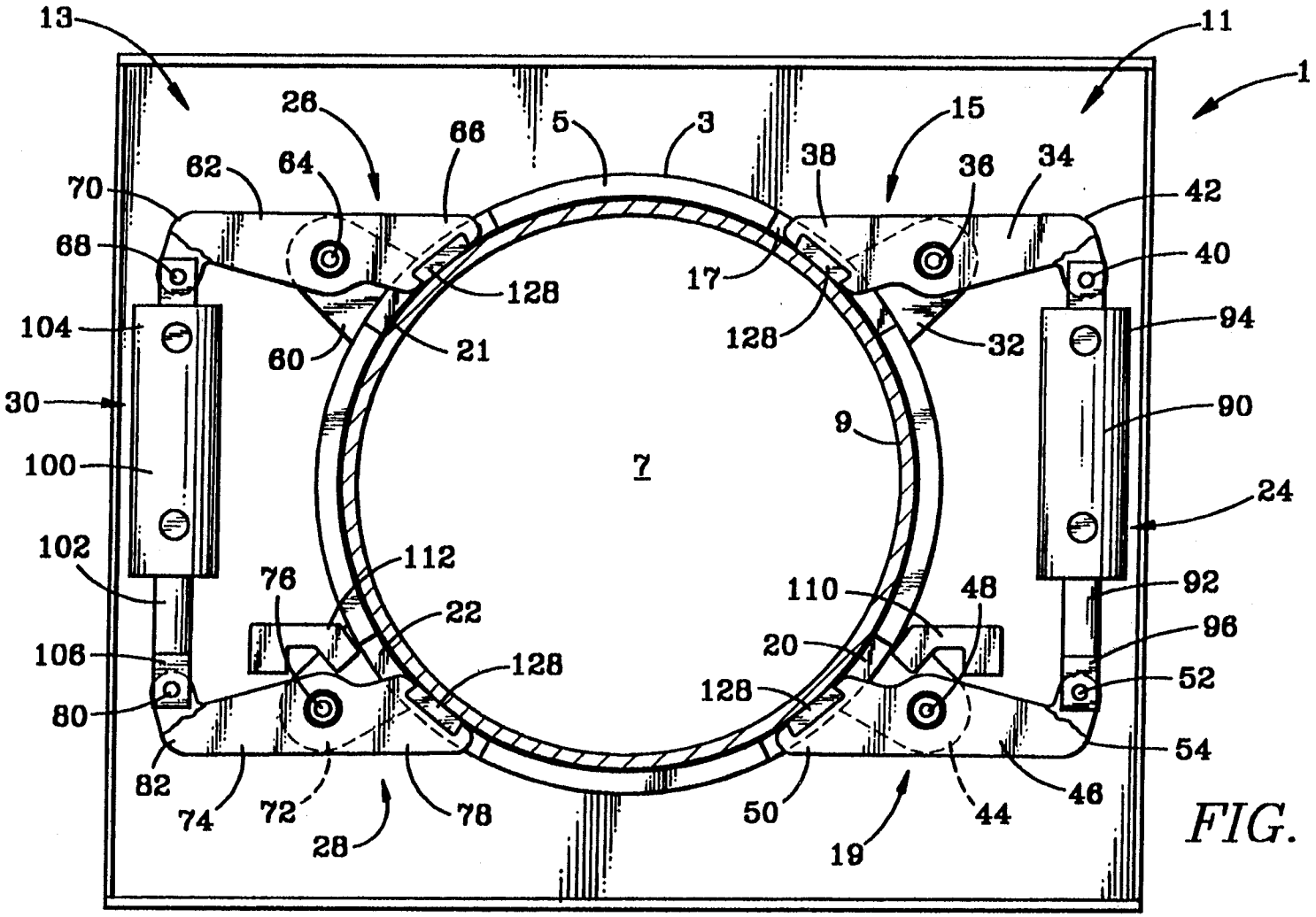
FIG. 1 is a cross-sectional, schematic plan view of the apparatus of this invention, with parts removed, and the gripping assemblies in the gripping position.
Figure 2:
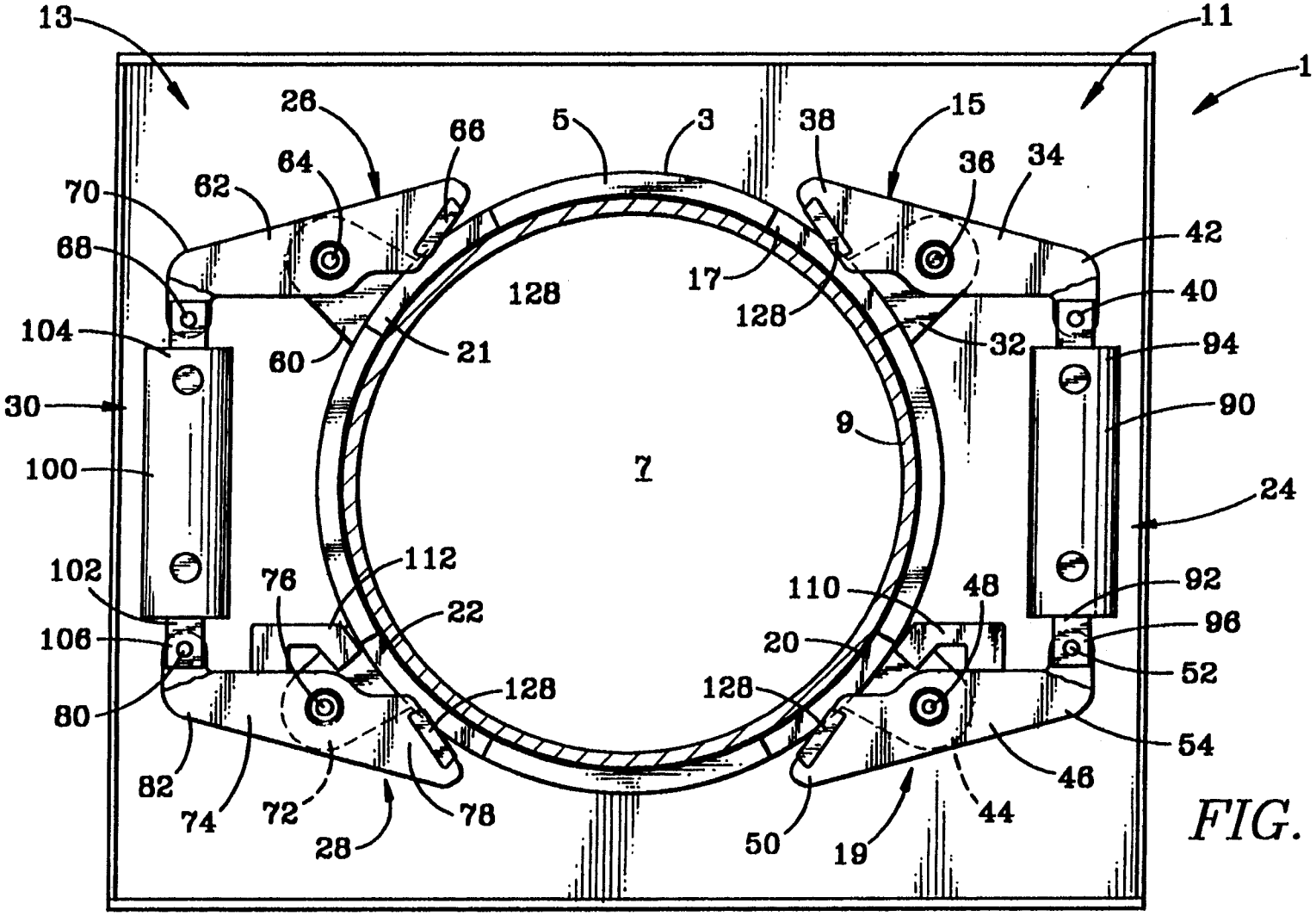
FIG. 2 is a view similar to FIG. 1, with the gripping assemblies in the opened position.

Referring to FIGS. 1 and 2, a drill tower platform is shown generally as 1, with a drill casing bushing 3 connected thereto. Bushing 3 is a hollow, vertically extending tubing, having a sidewall 5 forming a passageway 7 for drill casing 9 to pass vertically therethrough, as is well known.

A pair of casing gripping assemblies 11 and 13 are mounted on the platform 1 adjacent an outer surface of sidewall 5. Gripping assemblies 11, 13 are identical and are co-acting in a gripping stroke and a release stroke, as described hereinafter. Gripping assemblies 11 and 13 are spaced circumferentially around bushing 3 from each other at approximately opposite portions of sidewall 5.

A first gripping assembly 11 of the pair includes a first gripping jaw means 15 for extending into passageway 7 through an aperture 17 in sidewall 5, for contacting casing 9. Gripping assembly 11 also includes second gripping jaw means 19 for extending into passageway 7 through an aperture 20 in sidewall 5, for contacting casing 9. A first actuator means 24 is positioned for moving first and second gripping jaw means 15, 19, as described hereinafter.

Second gripping assembly 13, identical to first gripping assembly 11, includes a third gripping jaw means 26 for extending into passageway 7 through an aperture 21 in sidewall 5, for contacting casing 9. Gripping assembly 13 also includes fourth gripping jaw means 28 for extending into passageway 7 through an aperture 22 in sidewall 5, for contacting casing 9. A second actuator means 30 is positioned for moving third and fourth gripping jaw means 26, 28, as described hereinafter.

First gripping assembly 11 and second gripping assembly 13 are positioned circumferentially around sidewall 5 so that first and fourth gripping jaw means, 15 and 28 respectively, contact casing 9 at approximately diametrically opposite locations, and also so that second and third gripping jaw means, 19 and 26 respectively, contact casing 9 at approximately diametrically opposite locations that are approximately 90 degrees from first and fourth gripping jaw means, 15 and 28, respectively, as measured around the circumference of casing 9.

First and second actuator means, 24 and 30 respectively, are actuated by conventional means, preferably hydraulic circuitry, to cause all gripping jaw means, 15, 19, 26 and 28 to contact casing 9 at about the same time. Preferably, all gripping jaw means 15, 19, 26 and 28 are co-planar, that is, they operate in the same horizontal plane. However, alignments that are slightly not co-planar would work.

First gripping assembly 11 also includes a first support member 32 connected to an outer surface of sidewall 5, and extending horizontally outwardly therefrom. A first pivot arm 34 is pivotally connected to first support member 32 at pivot pin 36, by conventional means, such as a snap ring, not shown. First pivot arm 34 has first gripping jaw means 15 at one end 38 thereof, and a connection means 40 at a second end 42. Connection means 40 is preferably a clevis joint, but other pivotable connections will work. Connection means 40 pivotally connects to first actuator means, as described hereinafter.

First gripping assembly 11 also includes a second support member 44 connected to an outer surface of sidewall 5, and extending horizontally outwardly therefrom. A second pivot arm 46 is pivotally connected to second support member at pivot pin 48, by conventional means, such as a snap ring, not shown. Second pivot arm 46 has second gripping jaw means 19 at one end 50 thereof, and a connection means 52 at a second end 54. Connection means 52 is preferably a clevis joint, but other pivotable connections will work. Connection means 52 pivotally connects to second actuator means, as described hereinafter.

First gripping assembly 11 includes first actuator means 24 that extends between first and second pivot arms 34 and 46.

Second gripping assembly 13 also includes a third support member 60 connected to an outer surface of sidewall 5, and extending horizontally outwardly therefrom. A third pivot arm 62 is pivotally connected to third support member 60 at pivot pin 64, by conventional means, such as a snap ring, not shown. Third pivot arm 62 has third gripping jaw means 26 at one end 66 thereof, and a connection means 68 at a second end 70. Connection means 68 is preferably a clevis joint, but other pivotable connections will work. Connection means 68 pivotally connects to second actuator means, as described hereinafter.

Second gripping assembly 13 also includes a fourth support member 72 connected to an outer surface of sidewall 5, and extending horizontally outwardly therefrom. A fourth pivot arm 74 is pivotally connected to fourth support member 72 at pivot pin 76, by conventional means, such as a snap ring, not shown. Fourth pivot arm 74 has fourth gripping jaw means 28 at one end 78 thereof, and a connection means 80 at a second end 82. Connection means 80 is preferably a clevis joint, but other pivotable connections will work. Connection means 80 pivotally connects to second actuator means, as described hereinafter.

Second gripping assembly 13 includes second actuator means 30 that extends between first and second pivot arms 62 and 74.

First actuator means 24 includes a hydraulic cylinder 90 and rod 92 assembly. Cylinder 90 is pivotally connected at a barrel end 94 to first pivot arm 34, and rod 92 is pivotally connected at an external end 96 to second pivot arm 46. Connections are by clevis joints, but other types of pivotable connections will work.

Second actuator means 30 includes a hydraulic cylinder 100 and rod 102 assembly. Cylinder 100 is pivotally connected at a barrel end 104 to third pivot arm 62, and rod 102 is pivotally connected at an external end 106 to fourth pivot arm 74. Connections are by clevis joints, but other types of pivotable connections will work. First and second actuator means 24 and 30 are identical.

First gripping assembly 11 also includes a stop member 110 connected to second support member 44. The purpose for stop member 110 is to stop the movement of pivot arm 46 before the end of a release stroke of rod 90. The stopping of pivot arm 46 causes the cylinder 90 and pivot arm 46 to move away from casing 9, as the release stroke continues, thereby assuring complete disengagement of the casing by the gripping jaw means 15 and 19. A stop member 110 can be provided for either or both pivot arms 34 and 46, but I prefer only one.

Second gripping assembly 13 also includes a stop member 112 connected to fourth support member 72. The purpose for stop member 112 is to stop the movement of pivot arm 74 before the end of a release stroke. The stopping of pivot arm 74 causes the cylinder 100 and pivot arm 74 to move away from casing 9 as the release stroke continues, thereby assuring complete disengagement of the casing by the gripping jaw means 26 and 28. A stop member 112 can be provided for either or both pivot arms 62 and 74, but I prefer only one.

Figure 3:
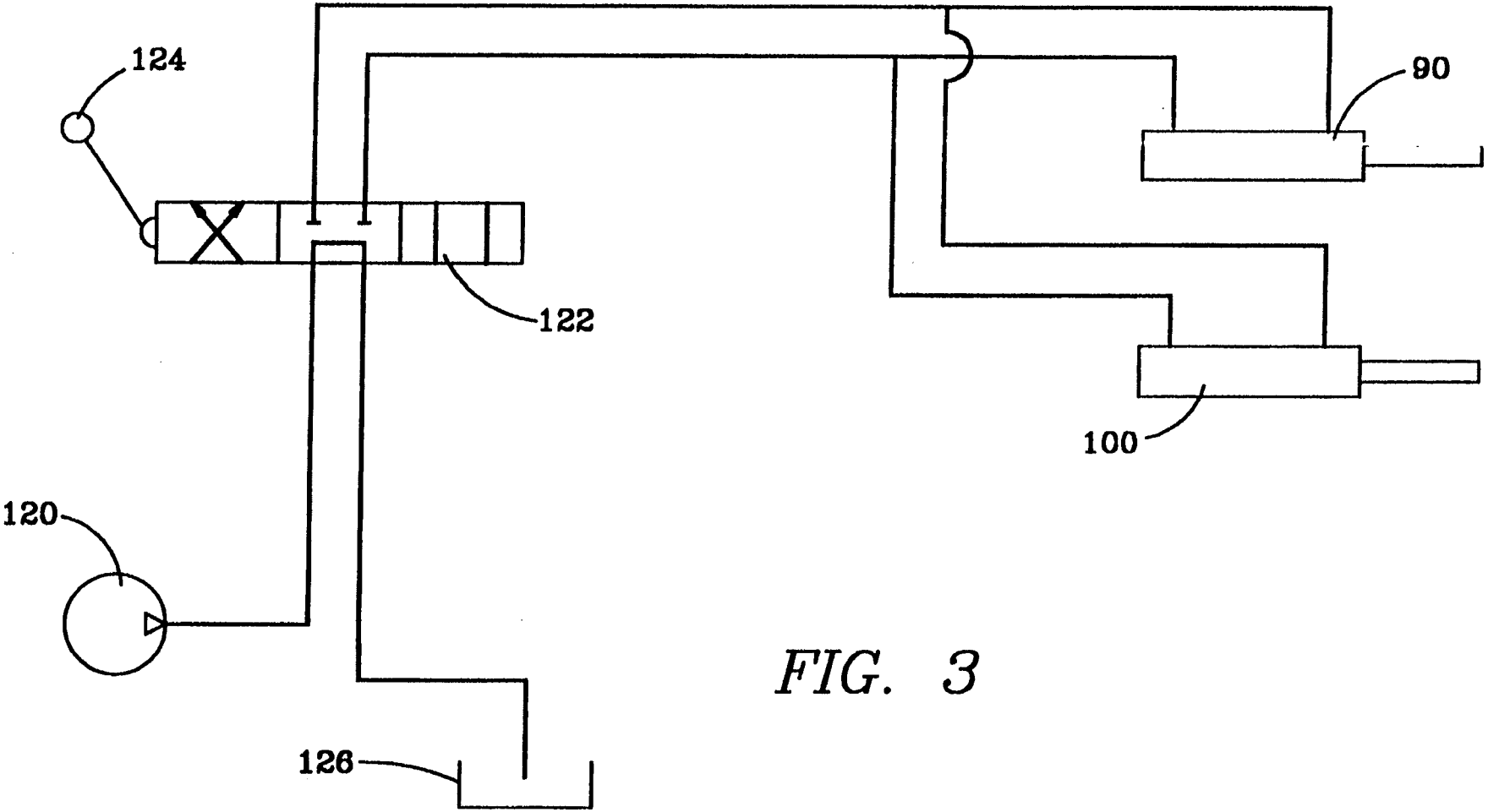
FIG. 3 is a hydraulic circuit for actuating the apparatus.

FIG. 3 shows an exemplary hydraulic circuit for operating the actuator means 24 and 30. A hydraulic pump 120 is connected to a three position, four-way valve 122, that is operated by lever 124. Cylinders 90 and 100 are connected in parallel to each other so that they operate simultaneously as regards stroke timing and power. When valve 122 is in neutral, the cylinders 90 and 100 are not being powered, and the circuit runs directly from pump 120 to tank 126, thereby saving in power requirements.

Each jaw means 15, 19, 26 and 28 includes a gripping portion 128 that is a hardened metal insert, as is well known.

The apparatus operates as follows: when it is desired to make or break joints, the casing 9 will be restrained using four jaw means 15, 19, 26 and 28 powered with hydraulic cylinders 90 and 100. Cylinders 90 and 100 are coupled hydraulically together to insure equal force between them, and are attached only to the jaw means 15, 19, 26 and 28, and are free to be positioned by them. Working in pairs, the jaws 15, 19, 26 and 28 access the casing 9 through slots or openings 17, 20, 21 and 22 the drill bushing 3, when hydraulic pressure/flow extends the cylinders. This action will clamp and center the casing 9, as shown in FIG. 1.

Due to the mechanism design, application of torque to the casing 9, along with the clamping force, causes diagonally opposite jaws 15 and 28, plus 19 and 26, one in each set, to be wedged into the casing 9, increasing the clamping force, thereby being a self-energizing force multiplier. The direction of rotation will only change which pair of opposing jaws are producing the wedging action.

To release the clamp, the hydraulic cylinder rods 92 and 102 are retracted which brings one jaw 19, 28, in each pair into contact with a stop 110, 112. When jaw 19, 28 stops, the cylinder barrel 94,104 then is caused to move, bringing the second jaws in each pair 15, 26 to retracted position shown in FIG. 2. This insures that the clamp completely clears the inside diameter of the drilling bushing.

The advantages of this system are that: there are no loose pieces to restrain or keep track of, it works quickly with just the positioning of a single hydraulic valve, it is not dependent of down pressure from anything and will not become stuck or jammed in either of its two positions.

Having described the invention, what is claimed is:

1. An apparatus on a drilling tower for gripping a drill casing comprising:

a. hollow, tubular bushing mounted on said tower in a vertically extending position, said bushing having a sidewall forming a passageway for a drill casing to pass vertically therethrough;

b. a pair of casing gripping assemblies mounted on said tower, adjacent an outer surface of said sidewall, said gripping assemblies co-acting in a gripping stroke and in a release stroke;

c. said pair of gripping assemblies spaced from each other adjacent approximately opposite portions of said sidewall;

d. a first gripping assembly of said pair comprising:

i. first gripping jaw means for gripping a casing;

ii. second gripping jaw means for gripping a casing; and iii. first actuator means for moving said first and second gripping jaw means into and out of contact with a casing;

e. a second gripping assembly of said pair comprising:

i. third gripping jaw means for gripping a casing;

ii. fourth gripping jaw means for gripping a casing; and iii. second actuator means for moving said third and fourth gripping jaw means into and out of contact with a casing; and f. said first and second gripping assemblies being positioned around said bushing so that said first and fourth gripping jaw means contact said casing at approximately diametrically opposite locations, and so that said second and third gripping jaw means contact said casing at approximately diametrically opposite locations approximately 90 degrees from said first and fourth gripping jaw means.

2. An apparatus on a drilling tower for gripping a drill casing comprising:

a. hollow, tubular bushing mounted on said tower in a vertically extending position, said bushing having a sidewall forming a passageway for a drill casing to pass vertically therethrough;

b. a pair of casing gripping assemblies mounted on said tower, adjacent an outer surface of said sidewall, said gripping assemblies co-acting in a gripping stroke and in a release stroke;

c. said pair of gripping assemblies spaced from each other adjacent approximately opposite portions of said sidewall;

d. a first gripping assembly of said pair comprising:

i. first gripping jaw means for extending into said passageway through an aperture in said sidewall, for contacting a casing therein;

ii. second gripping jaw means for extending into said passageway through an aperture in said sidewall, for contacting a casing therein; and iii. first actuator means for moving said first and second gripping jaw means into and out of said passageway;

e. a second gripping assembly of said pair comprising:

i. third gripping jaw means for extending into said passageway through an aperture in said sidewall, for contacting a casing therein;

ii. fourth gripping jaw means for extending into said passageway through an aperture in said sidewall, for contacting a casing therein; and iii. second actuator means for moving said third and fourth gripping jaw means into and out of said passageway;

f. said first and second gripping assemblies being positioned around said sidewall so that said first and fourth gripping jaw means contact said casing at approximately diametrically opposite locations, and so that said second and third gripping jaw means contact said casing at approximately diametrically opposite locations approximately 90 degrees from said first and fourth gripping jaw means; and g. means for a actuating said first and second actuator means to cause said first, second, third and fourth gripping jaw means to contact said casing at about the same time thereby securely gripping said casing.

3. The apparatus of claim 2 wherein said first, second, third and fourth gripping jaw means act in a single horizontal plane.

4. The apparatus of claim 3 wherein first gripping assembly comprises:

a. a first support member connected to an outer surface of said sidewall, and extending horizontally outwardly therefrom;

b. a first pivot arm pivotally connected to said first support member, said first pivot arm having said first gripping jaw means at a first end and a connection means at a second end, for pivotal connection to said first actuator means;

c. a second support member connected to an outer surface of said sidewall, and extending horizontally outwardly therefrom;

d. a second pivot arm pivotally connected to said second support member, said second pivot arm having said second gripping jaw means at a first end and a connection means at a second end, for pivotal connection to said first actuator means;

e. said first actuator means extending between said first and second pivot arms; and f. stop means for stopping movement of one of said pivot arms, before said release stroke ends.

5. The apparatus of claim 4 wherein said second gripping assembly comprises:

a. a third support member connected to an outer surface of said sidewall, and extending horizontally outwardly therefrom;

b. a third pivot arm pivotally connected to said third support member, said third pivot arm having said third gripping jaw means at a first end and a connection means at a second end, for connection to said second actuator means;

c. a fourth support member connected to an outer surface of said sidewall, and extending horizontally outwardly therefrom;

d. a fourth pivot arm pivotally connected to said fourth support member, said fourth pivot arm having said fourth gripping jaw means at a first end and a connection means at a second end, for connection to said second actuator means;

e. said second actuator means extending between said third and fourth pivot ares; and f. stop means for stopping movement of one of said pivot arms, before said release stroke ends.

6. The apparatus of claim 5 wherein said first and second actuator means each comprises:

a. a hydraulic cylinder and rod assembly, said rod telescopically movable within said cylinder, said cylinder pivotally connected at a barrel end to one of said pivot arms, said rod pivotally connected at an external end to another of said pivot arms.

* * * * *